US009387693B2

(12) United States Patent
Kobayashi

(10) Patent No.: US 9,387,693 B2
(45) Date of Patent: Jul. 12, 2016

(54) TWO-SIDED RECEIPT PRINTING METHOD, TWO-SIDED RECEIPT PRINTING DEVICE, AND RECORDING MEDIUM STORING A PROGRAM EXECUTED BY A CONTROL UNIT THAT CONTROLS A TWO-SIDED RECEIPT PRINTING DEVICE

(75) Inventor: Naoki Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 958 days.

(21) Appl. No.: 13/303,092

(22) Filed: Nov. 22, 2011

(65) Prior Publication Data

US 2012/0134735 A1 May 31, 2012

(30) Foreign Application Priority Data

Nov. 29, 2010 (JP) ..... 2010-265640

(51) Int. Cl.
*B41J 11/66* (2006.01)
*B41J 11/70* (2006.01)
*B41J 3/60* (2006.01)

(52) U.S. Cl.
CPC *B41J 3/60* (2013.01); *B41J 11/663* (2013.01); *B41J 11/70* (2013.01)

(58) Field of Classification Search
CPC ..... B41J 11/66; B41J 11/70; B41J 11/703; B41J 11/663; G06F 3/12
USPC ..... 400/621, 70, 645.1
See application file for complete search history.

(56) References Cited

U.S. PATENT DOCUMENTS

| | | | | |
|---|---|---|---|---|
| 4,621,326 | A * | 11/1986 | Rawlins | 705/43 |
| 6,824,322 | B2 * | 11/2004 | Miyajima | 400/621 |
| 7,623,145 | B2 * | 11/2009 | Taguchi | 347/171 |
| 7,782,349 | B2 | 8/2010 | Baba et al. | |
| 8,576,436 | B2 * | 11/2013 | McGarry et al. | 358/1.18 |
| 2005/0271446 | A1 * | 12/2005 | Minowa | 400/621 |
| 2006/0289633 | A1 | 12/2006 | Moreland et al. | |
| 2007/0172294 | A1 * | 7/2007 | Scarton | 400/621 |
| 2009/0290923 | A9 * | 11/2009 | Lyons et al. | 400/82 |
| 2013/0003097 | A1 * | 1/2013 | Yokoyama | 358/1.13 |

FOREIGN PATENT DOCUMENTS

| | | | |
|---|---|---|---|
| JP | 07-182565 | A | 7/1995 |
| JP | 2002-234215 | A | 8/2002 |
| JP | 2003-058950 | A | 2/2003 |
| JP | 2006-056009 | A | 3/2006 |

(Continued)

*Primary Examiner* — David Banh
(74) *Attorney, Agent, or Firm* — Kilpatrick Townsend & Stockton LLP

(57) ABSTRACT

A two-sided receipt printing method that prints on both sides of paper and produces receipts, and can reduce white space at the leading end of receipts without conveying the paper in reverse. A device that produces two-sided receipts has a cutter, a first printhead that prints on one side of the paper, and a second printhead that prints on the other side of the paper disposed at specific intervals along the paper conveyance path from the paper exit. When an end-of-transaction declaration is received, transaction information is printed by the second printhead and non-transaction information is printed by the first printhead. After printing the transaction information, header information of a length that fits between the cutter and the second print data is printed by the second printhead. The cutter then cuts the paper at a position between where the transaction information was printed and where the header information was printed.

11 Claims, 6 Drawing Sheets

(56) References Cited

FOREIGN PATENT DOCUMENTS

| | | | |
|---|---|---|---|
| JP | 2007-320188 | A | 12/2007 |
| JP | 2008-544403 | A | 12/2008 |
| JP | 2009-123028 | A | 6/2009 |
| JP | 2009-157833 | A | 7/2009 |
| WO | WO 2007/001795 | A1 | 1/2007 |

* cited by examiner

TWO-SIDED RECEIPT PRINTING METHOD, TWO-SIDED RECEIPT PRINTING DEVICE, AND RECORDING MEDIUM STORING A PROGRAM EXECUTED BY A CONTROL UNIT THAT CONTROLS A TWO-SIDED RECEIPT PRINTING DEVICE

Priority is claimed under 35 U.S.C. §119 from Japanese patent application No. JP 2010-265640 filed on Nov. 29, 2010, which is hereby incorporated by reference in its entirety.

BACKGROUND

1. Technical Field

The present invention relates to a method, device, and program for producing two-sided receipts by printing on both sides of paper using two printheads disposed to the paper conveyance path with a specific interval therebetween and then cutting the paper after printing is completed. More specifically, the invention relates to a method, device, and program that can reduce paper waste resulting from white space at the leading end of the receipt without conveying the paper in reverse.

2. Related Art

Receipt printers are commonly used in supermarkets and other retail stores. Such printers include printers that print on both sides of the paper in order to use paper more efficiently.

Japanese Unexamined Patent Appl. Pub. JP-A-2007-320188, for example, teaches technology enabling a duplex printer to print quickly by dividing the print data between the front and back sides of the paper.

Japanese Unexamined Patent Appl. Pub. JP-A-2009-123028 teaches technology for shortening receipt length by distributing the transaction information to be printed on the receipt to the front and back sides of the paper, and printing in areas other than the print areas where fixed information is printed.

These duplex printers have a cutter for cutting the printed paper, a first printhead for printing on one side of the paper, and a second printhead for printing on the other side of the paper disposed in this order from the downstream end of the paper conveyance path with specific intervals therebetween. Structurally this means that the cutter and the printhead on the upstream end are positioned with a specific distance therebetween, and unless some special action is taken after the paper is cut, white space equal to this distance is left as the leading end of the next receipt on the side that is printed by the printhead at the upstream end.

The paper could conceivably be moved to a specific position in reverse of the normal conveyance direction before printing starts in order to reduce this paper waste. The problem with this method is that it requires time to move the paper and some mechanical means of preventing the paper from jamming.

JP-A-2007-320188 does not describe a method of solving this problem. In addition, while JP-A-2009-123028 addresses white space formed by the distance between the two printheads, it does not address white space resulting from the distance between the cutter and the printheads.

SUMMARY

A two-sided receipt printing method, device, and program according to the invention for producing two-sided receipts by printing on both sides of paper using two printheads disposed to the paper conveyance path with a specific interval therebetween and then cutting the paper after printing is completed enable reducing paper waste resulting from white space at the leading end of the receipt without conveying the paper in reverse.

A first aspect of the invention is a two-sided receipt printing method for a device that prints transaction information, header information, and non-transaction information on paper for each transaction, and produces receipts using both sides of the paper, including steps of: starting conveyance of the paper when an end-of-transaction declaration is received, printing the non-transaction information on one side of the paper, and printing the transaction information on the other side of the paper; printing the header information, which has a specific length in the conveyance direction of the paper, on the other side of the paper after printing the transaction information; and stopping conveyance of the paper after printing the header information, and cutting the paper at a position between the area where the transaction information was printed and the area where the header information was printed.

In another aspect of the invention, when the device has a cutter that cuts the paper, a first printhead that prints on one side of the paper, a second printhead that prints on the other side of the paper, and a conveyance unit that conveys the paper along the conveyance path, disposed along the paper conveyance path from the paper exit with a specific interval therebetween, and the header information is information that is printed on the printed receipt before the transaction information on the same side as the transaction information, the method of printing two-sided receipts also has: a first step of starting conveyance of the paper by the conveyance unit when an end-of-transaction declaration is received, printing the transaction information by the second printhead, and printing the non-transaction information by the first printhead; a second step of printing the header information, the length of which in the conveyance direction of the paper is a length that will fit between the cutter and the second printhead, after printing the transaction information in the first step; and a third step of stopping conveyance by the conveyance unit after the second step, and cutting the paper by the cutter at a position between the area where the transaction information was printed and the area where the header information was printed.

Preferably, printing the non-transaction information is completed by the time printing the transaction information is completed.

In another aspect of the invention, the first printhead and the second printhead are inkjet printheads.

In another aspect of the invention, the first printhead and the second printhead are thermal printheads.

In another aspect of the invention, the length of the header information is slightly shorter than the separation distance between the cutter and the second printhead.

In another aspect of the invention, the header information includes a store logo.

Another aspect of the invention is a two-sided receipt printing device that prints transaction information, header information, and non-transaction information on paper for each transaction, and produces receipts using both sides of the paper, wherein: a cutter that cuts the paper, a first printhead that prints on one side of the paper, a second printhead that prints on the other side of the paper, and a conveyance unit that conveys the paper along the conveyance path, are disposed from a paper exit along a paper conveyance path with a specific interval therebetween; the header information is information that is printed on the printed receipt before the transaction information on the same side as the transaction information; the conveyance unit starts conveyance of the paper when an end-of-transaction declaration is received, the second printhead prints the transaction information, and the first printhead prints the non-transaction information; the second printhead prints the header information, the length of which in the conveyance direction of the paper is a length that will fit between the cutter and the second printhead, after printing the transaction information; and after the header information is printed, the conveyance unit stops conveyance of the paper, and the cutter cuts the paper at a position between the area where the transaction information was printed and the area where the header information was printed.

Another aspect of the invention is a computer-readable recording medium storing a program executed by a control unit that controls a device that prints transaction information, header information, and non-transaction information on paper for each transaction, and produces receipts using both sides of the paper, wherein when the device has a cutter that cuts the paper, a first printhead that prints on one side of the paper, a second printhead that prints on the other side of the paper, and a conveyance unit that conveys the paper along the conveyance path, disposed along the paper conveyance path from the paper exit with a specific interval therebetween, and the header information is information that is printed on the printed receipt before the transaction information on the same side as the transaction information, and the program includes as steps executed by the control unit, steps of: starting conveyance of the paper by the conveyance unit when an end-of-transaction declaration is received, printing the transaction information by the second printhead, and printing the non-transaction information by the first printhead; printing the header information, the length of which in the conveyance direction of the paper is a length that will fit between the cutter and the second printhead, after printing the transaction information; and stopping conveyance by the conveyance unit after printing the header information, and cutting the paper by the cutter at a position between the area where the transaction information was printed and the area where the header information was printed.

Other objects and attainments together with a fuller understanding of the invention will become apparent and appreciated by referring to the following description and claims taken in conjunction with the accompanying drawings.

DESCRIPTION OF EMBODIMENTS

Figure 1:
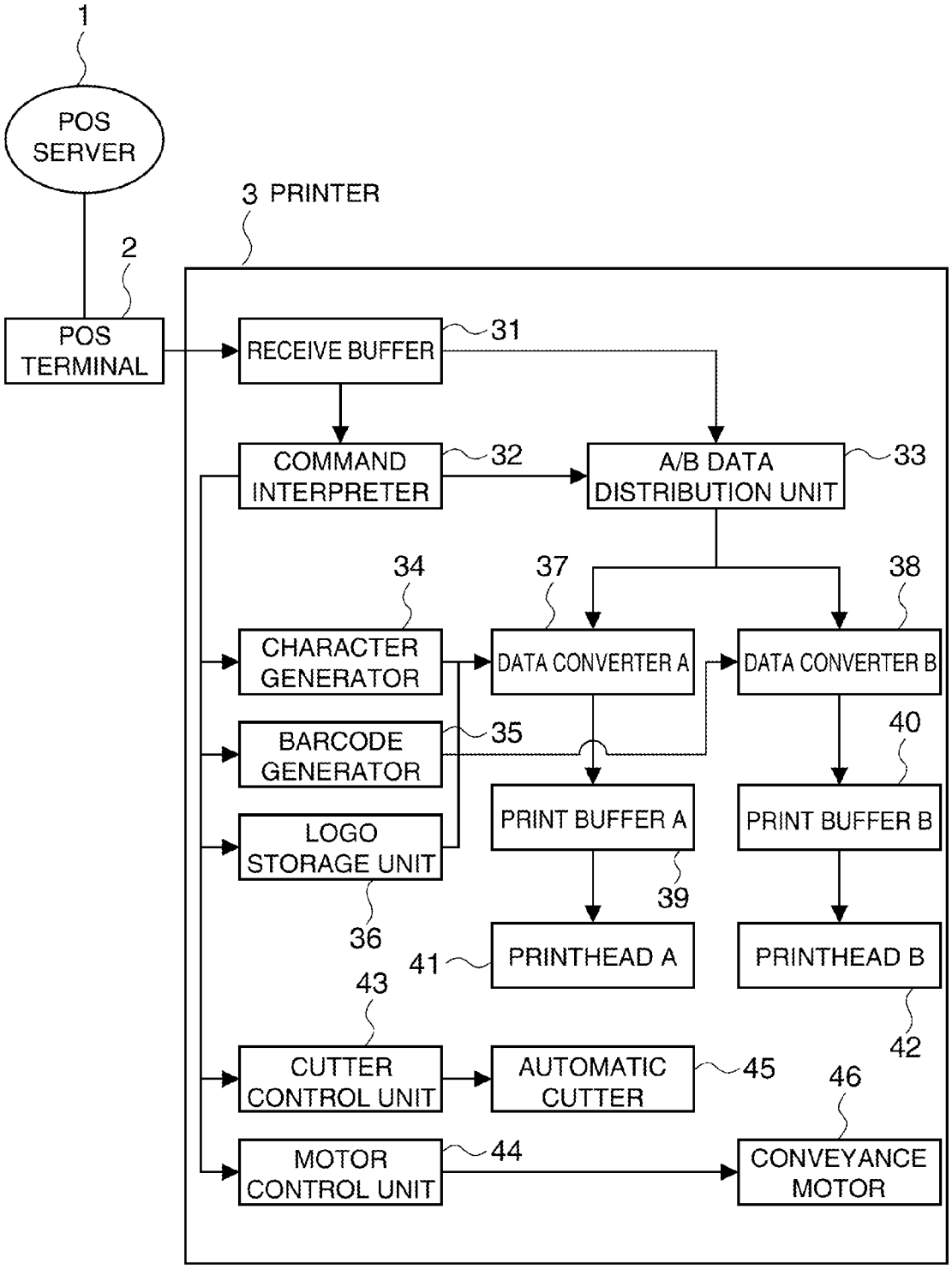
FIG. 1 is a block diagram of a preferred embodiment of a two-sided receipt printing device according to the invention.

A preferred embodiment of the present invention is described below with reference to the accompanying figures. The embodiments described below do not limit the technical scope of the invention. Note that like or similar parts are identified by the same reference numerals and symbols in the figures.

FIG. 1 is a block diagram of a preferred embodiment of a two-sided receipt printing device according to the invention. The printer 3 shown in FIG. 1 is a two-sided receipt printing device according to this embodiment of the invention. After printing transaction information by a printhead located on the upstream side in the paper conveyance direction, this printer 3 proceeds to print header information, such as a store logo that is printed at the leading end of each receipt, for the next receipt. As a result, the invention minimizes white space on the paper resulting from the distance between the cutter and the printhead.

As shown in FIG. 1, the printer 3 in this embodiment of the invention is installed in a store as part of a POS system, for example, and prints receipts based on requests from a POS terminal 2 that functions as an electronic cash register.

The POS server 1 is a computer system, is connected to a plurality of POS terminals 2, although only one is shown in FIG. 1, and executes processes for managing the POS terminals 2 and collecting and managing data acquired from the POS terminals 2.

A POS terminal 2 is installed at each cash register in the store, and includes a computer, keyboard, barcode reader, and display. A POS application that executes various processes and a printer 3 driver are installed in the computer, which processes data according to these. In order for the printer 3 to output a receipt, the POS terminal 2 sends data for printing the receipt (a print job) to the printer 3. Note that the print data consists of specific printer control commands.

The printer 3 is a receipt printer connected to the POS terminal 2, and is located beside the POS terminal 2. The printer 3 in this embodiment is a duplex thermal printer equipped with line heads.

The printer 3 also includes the units shown in FIG. 1.

The receive buffer 31 is a data storage unit for temporarily storing print data (referred to below as simply "commands") sent from the POS terminal 2, and is RAM.

The command interpreter 32 sequentially interprets the commands received in the receive buffer 31, and outputs the resulting commands appropriately to other parts.

The A/B data distribution unit 33 determines whether the image data to be printed on the paper 48, which is the print medium, is to be printed on side A of the paper 48 or the opposite side B.

The character generator 34 generates character images as instructed by the command interpreter 32. More specifically, the character generator 34 stores a character font, and outputs font data corresponding to the character codes received from the command interpreter 32.

The barcode generator 35 generates barcode images as instructed by the command interpreter 32. More specifically, the barcode generator 35 generates and outputs a barcode corresponding to the numbers received from the command interpreter 32.

The logo storage unit 36 identifiably stores data for predetermined images (image data) such as a store logo to be printed at the beginning of the receipt, and reads and outputs image data as instructed by the command interpreter 32. Non-volatile RAM (nonvolatile memory) is used for the logo storage unit 36, and images for printing the store logo as well as advertisements and coupons to be printed on receipts are stored in memory.

The data converter A 37 and data converter B 38 generate bitmap data for the images to be printed on side A and side B. More specifically, they convert data for the image objects output from the character generator 34, barcode generator 35, and logo storage unit 36 to pixel data.

Note that the command interpreter 32, A/B data distribution unit 33, character generator 34, barcode generator 35, logo storage unit 36, data converter A 37, and data converter B 38 are rendered by a CPU, RAM, and ROM devices, and various processes are executed by the CPU operating according to programs stored in ROM.

Print buffer A 39 and print buffer B 40 respectively store the bitmap data output from the data converter A 37 and data converter B 38, and are rendered in RAM. After data for one transaction (one receipt) is stored in each buffer, the data is printed to the paper 48 in the order it was stored.

Figure 2:
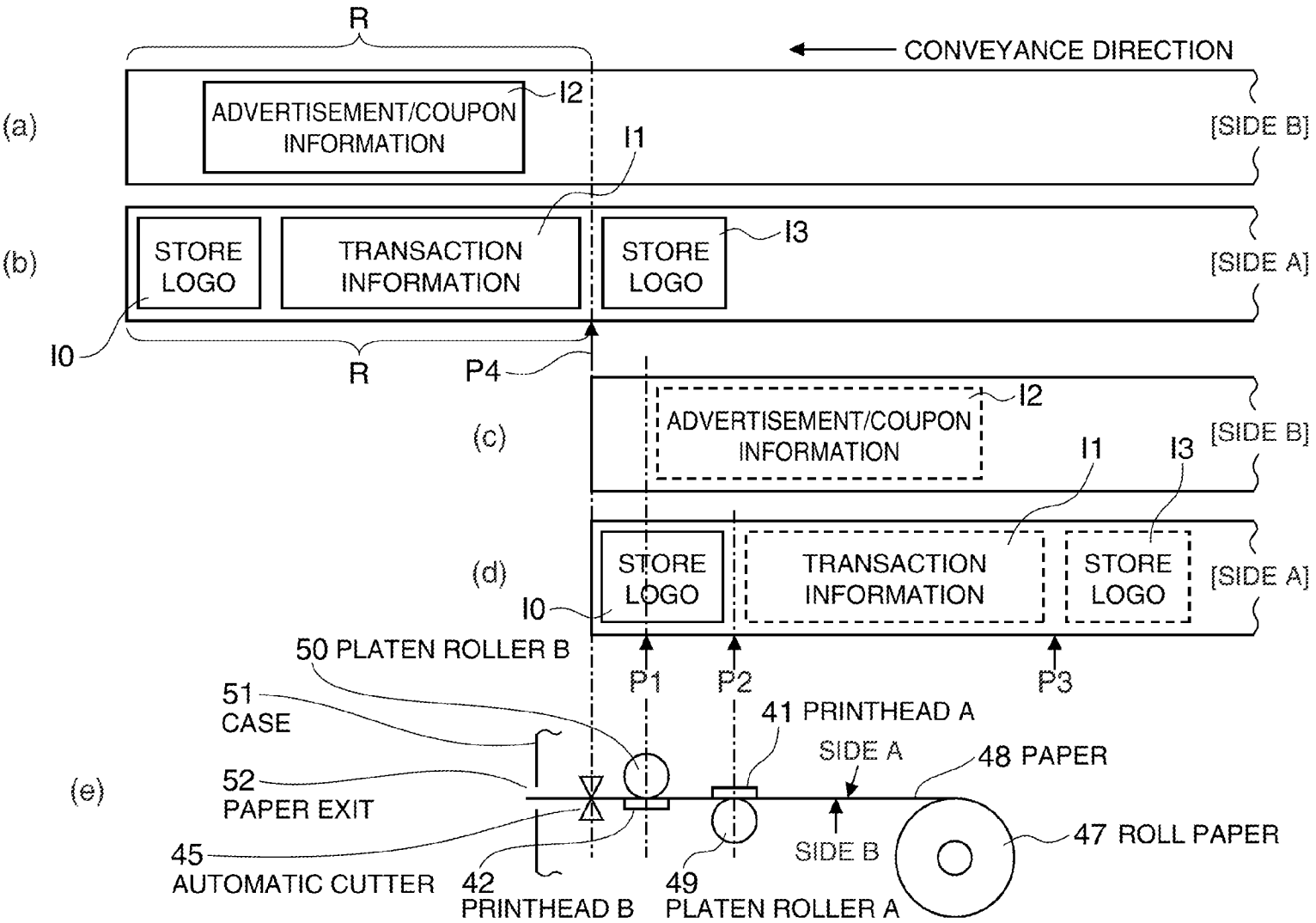
FIG. 2 describes receipt printing in the printer 3.

The printer 3 has printhead A 41 (second printhead) and printhead B 42 (first printhead) as the parts that print respectively to side A and side B. FIG. 2 describes printing a receipt in this printer 3.

FIG. 2 (*e*) shows the configuration of the paper conveyance path in the printer 3. Each printhead is a line head with heat elements (resistors). As shown in FIG. 2 (*e*), printhead A 41 and printhead B 42 are pressed against a respectively corresponding platen roller A 49 and platen roller B 50, and print to the paper 48 conveyed between each printhead and platen roller.

The printer 3 also has a roll paper 47 storage unit, the above platen roller A 49 and platen roller B 50, a conveyance motor 46 that makes the platen rollers turn, a motor control unit 44, an automatic cutter 45 that cuts the paper 48, a cutter control unit 43 that controls the cutter, and a paper exit 52 that is an opening formed in the case 51 of the printer 3 from which the paper 48 is discharged, as paper 48 handling devices.

The roll paper 47 is conveyed as the paper 48 between the printheads and platen rollers that are pressed together as described above toward the paper exit 52 by rotation of the platen rollers, printed on by the printheads while being conveyed, cut by the automatic cutter 45 at a specific position where the receipt ends, and discharged from the printer 3.

A novel feature of the printer 3 configured as described above is the sequence of steps whereby a receipt is produced, and more particularly by the method of printing header information such as a store log that is printed at the beginning of the receipt, as described more specifically below. The content printed on a receipt produced by the printer 3 is described first.

Figure 3:
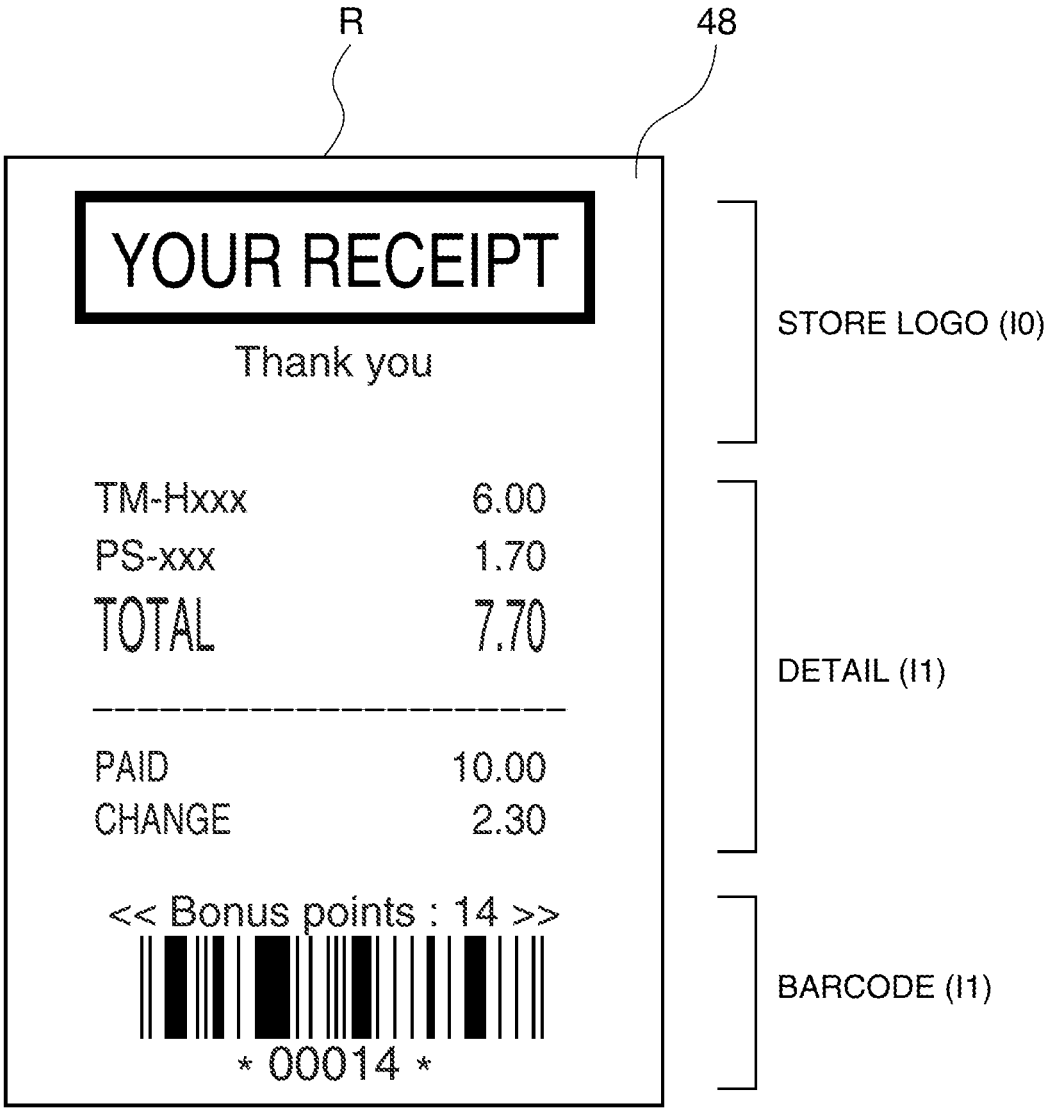
FIG. 3 shows an example of a receipt output from the printer 3.

FIG. 3 shows an example of a receipt produced by the printer 3. FIG. 3 shows one side of the receipt R printed on the paper 48, specifically side A in this embodiment of the invention, and the content printed on this side includes, as shown in the figure, a stamp, detail, and a barcode. The stamp does not include a store log in this example, but is the header information (I0) printed at the beginning of the receipt as described above, and is common information printed on every receipt before the transaction information on the same side as the transaction information. The header information (I0) is normally fixed information such as a message or store logo. Because of where the stamp is printed, the command for printing this stamp when received from the POS terminal 2 is the next command after the initialization command in the string of commands for the transaction content (one receipt), that is, first in the string of commands specifying what is to be printed. The stamp image is output from the logo storage unit 36 and/or character generator 34.

The detail is the main part of the receipt and includes the name and price of each product purchased and the purchase total, and the image printed as the detail is output primarily from the character generator 34.

The barcode contains a transaction ID identifying the transaction, and the image printed as the barcode is output from the barcode generator 35.

The detail and the barcode correspond to the transaction information (I1) of the receipt, and the commands for printing these when received from the POS terminal 2 in the string of commands for one transaction follow the stamp command, that is, the stamp print command is followed by the detail and then the barcode print commands.

Note that side B is not shown in the figure, but advertisement and coupon information is printed on side B. Note that this advertisement and coupon information is non-transaction information (I2). This non-transaction information includes fixed information that always presents the same content, and/or variable information that may change according to the date, time, or purchased products, for example. The non-transaction information may also include text, images, and barcodes.

While the printer 3 prints this type of receipt, it is important to note that the size of the stamp after it is printed (the height as seen in FIG. 3), that is, the length in the paper 48 conveyance direction, is less than the separation distance in the conveyance direction between the automatic cutter 45 and the printhead A 41. More specifically, the length of the stamp and this separation distance are substantially the same with the length of the stamp being slightly shorter.

Figure 4:
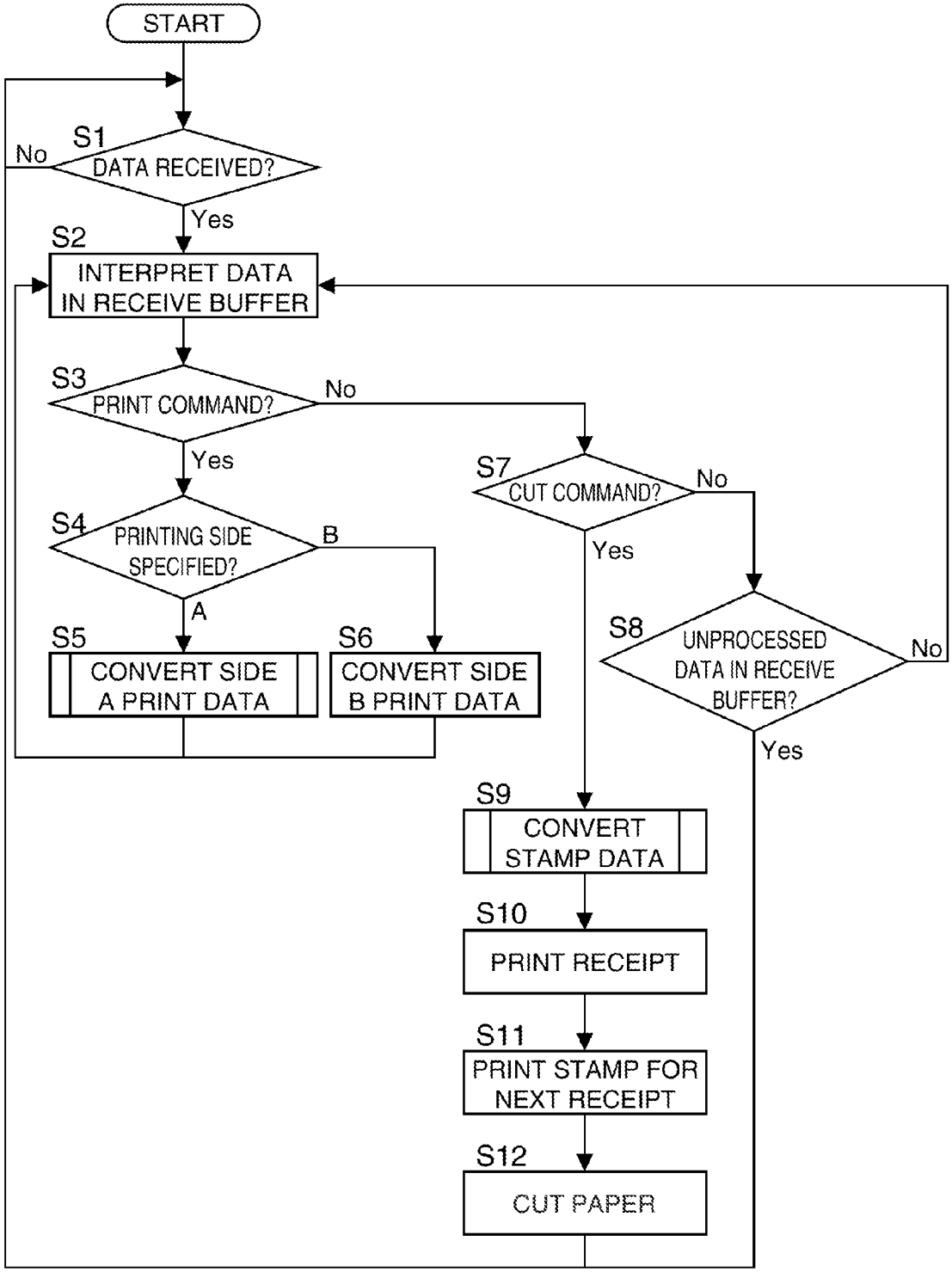
FIG. 4 is a flow chart of the receipt printing process.

Specific steps in the receipt printing process of the printer 3 are described next. FIG. 4 is a flow chart of the steps in the receipt printing process. The process for printing one transaction is described below.

The printer 3 first waits to receive the above commands (print data) sent from the POS terminal 2 (step S1 returns No), and stores the commands in the receive buffer 31 as received (step S1 returns Yes). The command interpreter 32 then interprets the command in the receive buffer 31 in the order received (step S2).

The command interpreter 32 then determines if the interpreted commands are print commands (step S3). Print commands as used here mean commands for printing the foregoing content (header information, transaction information, non-transaction information) for a receipt. Because a command for printing a receipt for one transaction normally starts with an initialization command, control goes to step S7 if it is determined at the first stage of command interpretation that the command is not a print command (step S3 returns No).

Whether the command is a cut command is then determined in step S7. A cut command instructs cutting the paper 48 with the automatic cutter 45, and is therefore equivalent to an end-of-transaction declaration. More specifically, the cut command is usually the last command in a print job. Because the command evaluated at this time is an initialization command, it is determined to not be a cut command (step S7 returns No), the instruction specified by the command is executed, and control goes to step S8.

If an unprocessed command remains in the receive buffer 31 is determined in step S8. Because at this point there is normally a print command that has not yet been executed (step S8 returns No), control returns to step S2 and the next command is interpreted.

Control next returns to step S3, and because a command to print the stamp is normally detected once the initialization command process is completed, a print command is detected (step S3 returns Yes), and the A/B data distribution unit 33 determines which side to print on (step S4). Because information indicating whether to print on side A or to print on side B is included in the received commands, this determination is made based on this information. Because a print stamp command is detected here, the A/B data distribution unit 33 determines that printing on side A is required (step S4 returns A).

If a detail or barcode print command that should normally follow a print stamp command is detected, the same result as when a print stamp command is detected is returned (step S3 returns Yes, and step S4 returns A).

However, if a print command for advertisement and coupon information (non-transaction information) that is printed on side B is detected, the same method determines that printing on side B is required (step S3 returns Yes, and step S4 returns B).

Figure 5:
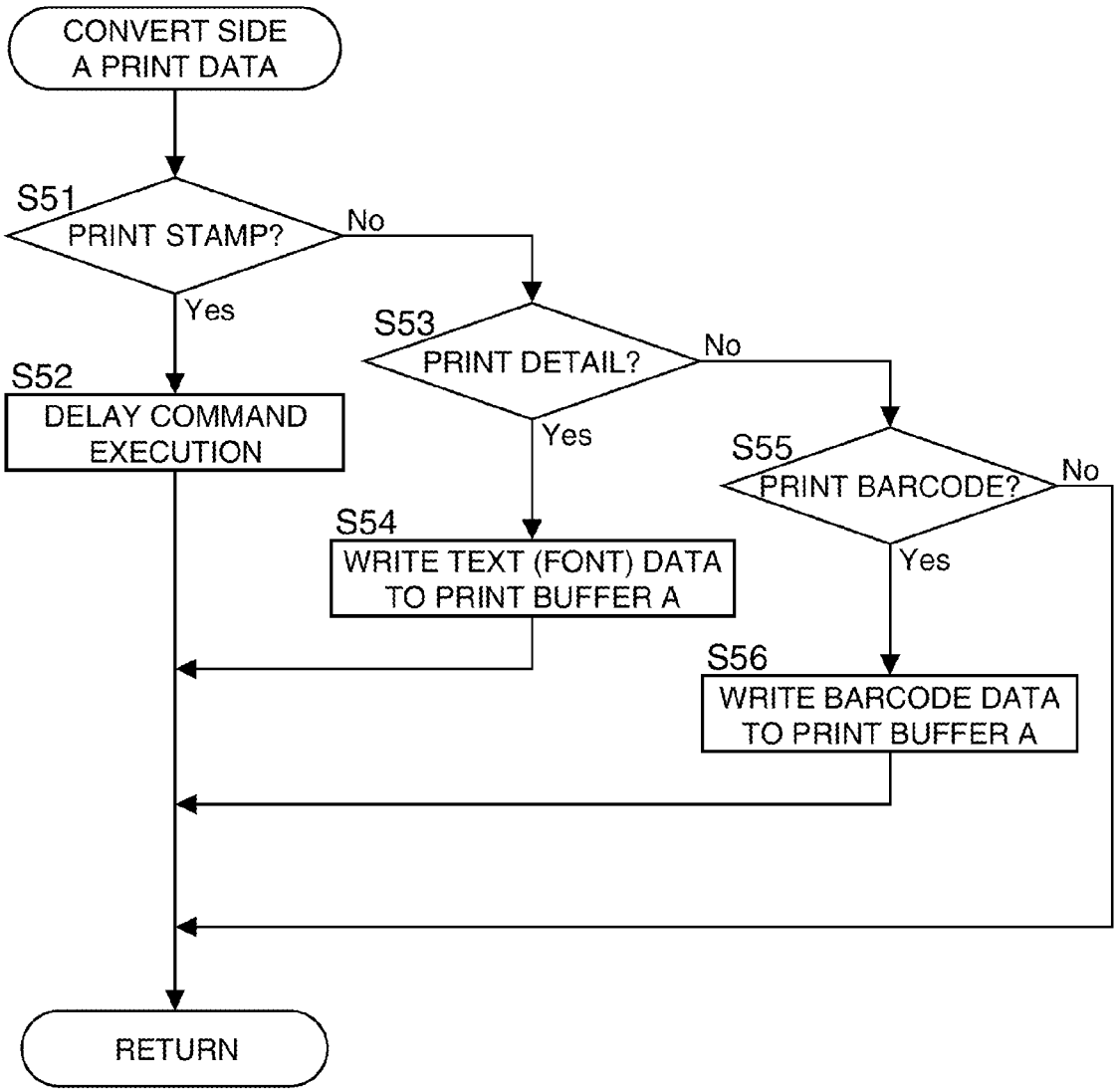
FIG. 5 is a flow chart showing the steps in the side A conversion process.

When printing on side A is instructed, the side A print data conversion process is executed (step S5). FIG. 5 is a flow chart of the steps in the side A print data conversion process.

This process starts with the command interpreter 32 determining if the print command is related to printing a stamp, printing detail, or printing a barcode (step S51, S53, S55). If the command is for printing a stamp (step S51 returns Yes), the command interpreter 32 delays executing the command (step S52). That command execution was delayed is also stored. Because the stamp data conversion process is not executed in this process, bitmap data for the stamp is not stored in print buffer A at this time.

If the command is related to printing detail (step S53 returns Yes), the font data output from the character generator 34 is converted to bitmap data by data converter A 37 because the detail is normally text, and the converted data is written to print buffer A 39 (step S54).

If the command is related to printing a barcode (step S55 returns Yes), the barcode data output from the barcode generator 35 is converted to bitmap data by data converter A 37, and the converted data is written to print buffer A 39 (step S56).

Next, if step S4 in FIG. 4 determines that printing on side B is required, the images in the advertisement and coupon information (non-transaction information) are output from the character generator 34, barcode generator 35, or logo storage unit 36, and the output images are converted by data converter B 38 to bitmap data (step S6). The converted data is stored in print buffer B 40.

Because a cut command is interpreted by the command interpreter 32 at the end of one transaction after the print command processes end (step S3 returns No, and step S7 returns Yes), control goes to step S9.

Figure 6:
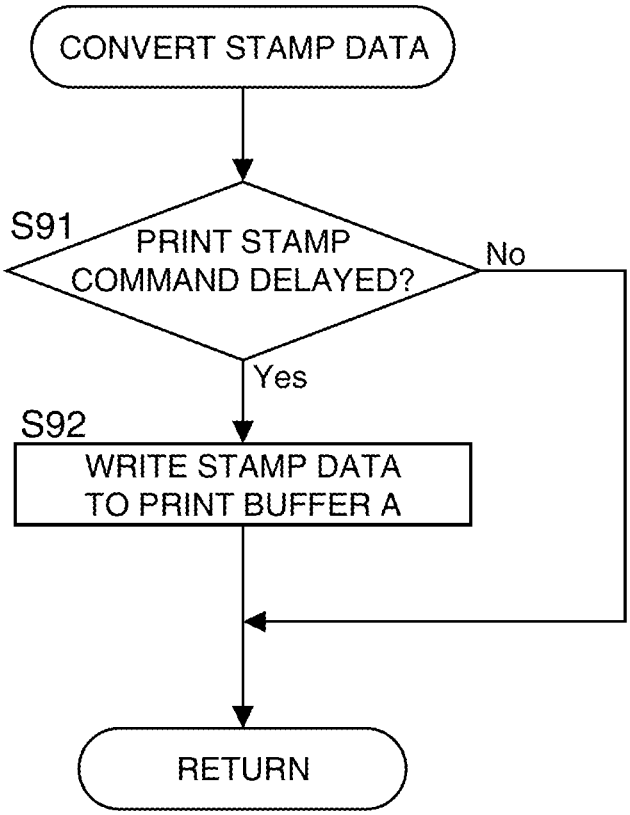
FIG. 6 is a flow chart showing the steps in the stamp data conversion process.

The stamp data conversion process executes in step S9. FIG. 6 is a flow chart of the steps in this process.

In this process the command interpreter 32 checks if there is a delayed print stamp command (step S91), and the process ends if a command was not delayed (step S91 returns No).

If a command was delayed (step S91 returns Yes), the command interpreter 32 starts the stamp conversion process, the data converter A 37 converts the data output from the logo storage unit 36, for example, to bitmap data, and saves the converted data to print buffer A 39 (step S92). As described above, bitmap data for the detail and barcode is normally already stored in print buffer A 39 at this time, and the stamp data is therefore saved after the detail and barcode data.

Returning again to FIG. 4, the printer 3 starts the printing process because a cut command, which means the end of one transaction, has already been interpreted, and reads and sequentially outputs the bitmap data stored in the print buffers (39, 40) to the printheads (41, 42).

When the printing process starts, the conveyance motor 46 operates and starts conveying the paper 48, and the printheads (41, 42) start printing on both sides at the same time. On side A, the detail is printed first and the barcode is then printed by the printhead A 41 in the order stored in print buffer A 39. On side B, the advertisement and coupon information is printed by printhead B 42 according to the data stored in print buffer B 40.

Receipt printing for the current transaction (receipt) is completed by the printing process to this point. While the stamp portion of this transaction has still not been printed, the stamp of the receipt for this transaction was already printed by the printing method used by the printer 3 on the downstream end of the paper 48 during the previous printing process.

Without stopping paper 48 conveyance, the printer 3 then proceeds to print the bitmap data for the stamp stored in print buffer A 39 after the barcode data in step S92 described above (step S11). The stamp is printed on side A by printhead A 41, but this stamp is printed for the next transaction, and the printed stamp is located in the header part of the next receipt.

Printing by the printheads (41, 42) ends after the stamp is printed. The paper 48 is then conveyed until the automatic cutter 45 is located at a position between the printed barcode and the printed stamp, the conveyance motor 46 then stops, and paper 48 conveyance stops.

The paper 48 is then cut by the automatic cutter 45 (step S12), the receipt printed for the current transaction is discharged from the paper exit 52, and the receipt printing process ends. The stamp printed in the previous printing process, and the detail and barcode printed in the current printing process, are printed in this same order on side A of the issued receipt, resulting in a receipt such as shown in FIG. 3.

The relative positions of the paper 48 in the foregoing printing process are described next with reference to FIG. 2. In FIG. 2, (c) and (d) show the location of the paper 48 and the condition of each side (side B and side A) when the printing process starts (step S10 in FIG. 4). The store logo I0 indicated by the solid line in the figure is the stamp that was already printed in the previous printing process. The transaction information I1, advertisement/coupon information I2, and store logo I3 indicated by dotted lines indicate the printing positions of the information that has not yet been printed and will be printed in the current printing process. Note that the transaction information I1 includes the detail and barcode as described above, and the store logo I3 is the stamp described above.

When printing starts, the paper 48 moves in the direction indicated by the arrow in the figure, and printhead B 42 and printhead A 41 start printing at the same time. Printing starts from position P1 in the figure on side B, and starts from position P2 in the figure on side A.

Paper 48 conveyance and printing then proceed, and printing transaction information I1 ends when position P3 of the paper 48 reaches the printhead A 41. While printing the advertisement/coupon information I2 has already ended before this time in the example shown in FIG. 2 because the advertisement/coupon information I2 printed on side B is shorter than the transaction information I1, the length of the advertisement/coupon information I2 is controlled so that printing the advertisement/coupon information I2 will at the latest end at this time.

As described above, the printing process continues on side A until the store logo I3 is printed and the paper 48 is conveyed to the cutting position. FIGS. 2 (*a*) and (*b*) show the position of the paper 48 and the state of both sides (side B and side A) at this time. Note that transaction information I1, advertisement/coupon information I2, and store logo I3 are indicated by solid lines because printing is already completed.

Because the length of the store logo I3 in the paper conveyance direction is substantially equal to and slightly shorter than the separation distance in the paper conveyance direction between the automatic cutter 45 and the printhead A 41 in the example shown in FIG. 2, paper conveyance stops immediately after printing the store logo I3 ends, and the paper 48 stops as shown in (a) and (b).

In addition, because the length of the store logo I3 is less than the distance of separation between the automatic cutter 45 and printhead A 41 as described above, the printed store logo I3 will not appear downstream in the conveyance direction from the automatic cutter 45 when printing the store logo I3 ends. Because the receipt should be cut between the transaction information I1 and the (next) store logo I3, limiting the length of the store logo I3 eliminates any need to convey the paper 48 in reverse.

Furthermore, if the length of the store logo I3 is significantly shorter than the separation distance, significant white space will result between the store logo I0 and the transaction information I1. This white space is undesirable in terms of efficient paper use and appearance.

After conveyance stops, the paper is cut at position P4 in the figure, that is, between the trailing end of the transaction information I1 and the beginning of the store logo I3, and the portion indicated by R in the figure is issued as the receipt for the current transaction. The store logo I0 printed in the previous printing process is used on this receipt, and the store logo I3 printed in the current printing process is used on the next receipt.

A receipt R that has a good appearance and little white space on the side (side A) on which the transaction information I1 is printed can thus be produced without conveying the paper 48 in reverse.

When producing a receipt having transaction information printed on one side and non-transaction information printed on the other side, a printer 3 according to this embodiment of the invention as described above prints transaction information using a printhead located on the upstream side in the paper conveyance direction; sets the length of header information such as a store logo that is printed above the transaction information (before the transaction information) to a length that is within the distance between the automatic cutter and the printhead; stores the data for the header information before printing to a position where it will be printed below the transaction information (after the transaction information); and after printing the transaction information and the following header information, cuts the paper at a position between the printed transaction information and the header information and issues a receipt.

The printed header information therefore remains on the paper between the automatic cutter and the printhead, and a suitable receipt having header information printed at the top can be produced by starting printing from that position in the next printing process. As a result, paper waste caused by white space can be minimized without conveying the paper in reverse. Furthermore, because the paper is not conveyed in reverse, the mechanical configuration can be simplified and time for reversing the paper is not needed.

Furthermore, because printing non-transaction information on the opposite side is completed by the time printing the transaction information ends, the area that is printed when printing the header information is limited to one side, and sufficient power supply capacity can be assured even if a store logo or other content with a high print density is in the header information because printheads are not energized simultaneously on both sides.

Furthermore, by limiting the size of the header information to slightly shorter than the distance between the automatic cutter and the printhead, receipts with a good appearance can be produced.

While the printer 3 described in the foregoing embodiment is a thermal printer, an inkjet printer with a line head could be used instead. Receipts can be printed in the same way in this case by printing with inkjet printheads. Time for the ink to dry must be considered in the case of an inkjet printer, but sufficient drying time can be assured even if a store logo or other content with a high print density is in the header information if the receipt printing method of the invention is used because the header information is printed when printing the previous receipt.

The processes executed by the two-sided receipt printing device described above can also be embodied as a computer-executable program. This program can also be provided stored on a suitable recording medium such as a hard disk drive, optical disc, magneto-optical disk, or flash memory.

The POS terminal 2 and printer 3 are separate in the embodiment described above, but the invention can obviously also be applied to a configuration in which these are combined in a single device.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A two-sided receipt printing method for a device that prints transaction information, header information, and non-transaction information on paper for each transaction, and produces receipts using two sides of the paper, comprising steps of:

starting conveyance of the paper when an end-of-transaction declaration is received, printing the non-transaction information on a first side of the paper, and printing the transaction information on a second side of the paper, wherein printing of the transaction information and non-transaction information begins at the same time;

completing printing the non-transaction information;

completing printing the transaction information after completing printing the non-transaction information;

printing the header information, which has a specific length in a conveyance direction of the paper, on the second side of the paper after completing printing the transaction information; and stopping conveyance of the paper after printing the header information, and cutting the paper at a position between a first area where the transaction information was printed and a second area where the header information was printed using a cutter;

wherein a first print head that prints the transaction information and the header information on the first side is located upstream from a second print head that prints the non-transaction information the second side of the paper and from the cutter.

2. The two-sided receipt printing method of claim 1, wherein the first printhead and the second printhead are inkjet printheads.

3. The two-sided receipt printing method of claim 1, wherein the first printhead and the second printhead are thermal printheads.

4. The two-sided receipt printing method of claim 1, wherein the length of the header information is slightly shorter than a distance between the cutter and the second printhead.

5. The two-sided receipt printing method of claim 1, wherein the header information includes a store logo.

6. A two-sided receipt printing device that prints transaction information, header information, and non-transaction information on paper for each transaction, and produces receipts using two sides of the paper, comprising:

a cutter that cuts the paper;

a first printhead that prints on a first side of the paper;

a second printhead that prints on a second side of the paper; and a conveyance unit that conveys the paper along a conveyance path, wherein the cutter, the first printhead, the second printhead, and the conveyance unit are disposed along the conveyance path, wherein the first printhead is located upstream from the second printhead and from the cutter;

the conveyance unit starts conveyance of the paper when an end-of-transaction declaration is received, the second printhead prints the transaction information, and the first printhead prints the non-transaction information, wherein printing of the transaction information and non-transaction information begins at the same time;

the first printhead completes printing the non-transaction information;

the second printhead completes printing the transaction information after the first printhead has completed printing the non-transaction information;

the second printhead prints the header information, a length of which in a conveyance direction of the paper is a length that will fit between the cutter and the second printhead, after the second printhead has completed printing the transaction information; and after the header information is printed, the conveyance unit stops conveyance of the paper, and the cutter cuts the paper at a position between a first area where the transaction information was printed and a second area where the header information was printed.

7. The two-sided receipt printing device of claim 6, wherein the first printhead and the second printhead are inkjet printheads.

8. The two-sided receipt printing device of claim 6, wherein the first printhead and the second printhead are thermal printheads.

9. The two-sided receipt printing device of claim 6, wherein the length of the header information is slightly shorter than a distance between the cutter and the second printhead.

10. The two-sided receipt printing device of claim 6, wherein the header information includes a store logo.

11. A computer-readable recording medium storing a program executed by a control unit that controls a device that prints transaction information, header information, and non-transaction information on paper for each transaction, and produces receipts using two sides of the paper, wherein the device comprises a cutter that cuts the paper, a first printhead that prints on a first side of the paper, a second printhead that prints on a second side of the paper, and a conveyance unit that conveys the paper along a conveyance path, wherein the cutter, the first printhead, the second printhead, and the conveyance unit are disposed along the conveyance path, wherein the first printhead is located upstream from the second printhead and from the cutter, and the header information has a length in a conveyance direction of the paper that will fit between the cutter and the second printhead, and the program comprises as steps executed by the control unit, steps of:

starting conveyance of the paper by the conveyance unit when an end-of-transaction declaration is received, printing the transaction information by the second printhead, and printing the non-transaction information by the first printhead, wherein printing of the transaction information and non-transaction information begins at the same time;

completing printing the non-transaction information;

completing printing the transaction information after completing printing the non-transaction information;

printing the header information after completing printing the transaction information; and stopping conveyance by the conveyance unit after printing the header information, and cutting the paper by the cutter at a position between a first area where the transaction information was printed and a second area where the header information was printed.

* * * * *